US005335390A

United States Patent [19]

Chen

[11] Patent Number: 5,335,390

[45] Date of Patent: Aug. 9, 1994

[54] STRUCTURE OF FOLDABLE COMB

[75] Inventor: Chin-Yan Chen, San Chung, Taiwan

[73] Assignee: Jong Ching Brushes Co., Ltd., Taipei Hsien, Taiwan

[21] Appl. No.: 12,396

[22] Filed: Feb. 2, 1993

[51] Int. Cl.[5] ..... A46B 7/00; A45D 24/06

[52] U.S. Cl. ..... 15/185; 15/203; 132/121; 132/129

[58] Field of Search ..... 15/184, 185, 203; 132/119, 121, 123, 129, 134, 135, 151, 203, 219

[56] References Cited

U.S. PATENT DOCUMENTS

| | | | |
|---|---|---|---|
| 851,567 | 4/1907 | Sutherland | 132/151 |
| 1,592,510 | 7/1926 | Toepperwein | 15/203 |
| 3,651,532 | 3/1972 | Wettburg | 15/186 |
| 4,023,230 | 5/1977 | Friedman | 15/185 |
| 4,987,633 | 1/1991 | Heneveld | 132/121 |

FOREIGN PATENT DOCUMENTS

| | | | |
|---|---|---|---|
| 67985 | 10/1957 | France | 15/184 |

*Primary Examiner*—Timothy F. Simone
*Assistant Examiner*—Randall E. Chin
*Attorney, Agent, or Firm*—Pro-Techtor International

[57] ABSTRACT

An improved structure of a foldable comb having a handle and a hollowed frame pivotally connected therewith, the hollowed frame has an elastic member for implanting thereon a plurality of brush pins. The handle provides an eccentric wheel at the pivotal connection thereof, a push rod having a block thereon can be moved with the eccentric wheel and having an elongated shank thereof inserted into a rod sheath beneath an elastic member in a cavity of the hollowed frame to move therewith; therefore a plurality of brush pins on the elastic member being capable of stretching automatically when the handle and the hollowed frame being spreaded and being capable of contracting automatically for storage when the handle and the hollowed frame being folded.

2 Claims, 5 Drawing Sheets

STRUCTURE OF FOLDABLE COMB

The present invention concerns an improvement in structural design of a foldable comb, and especially concerns one of which the brush portion needs not to be pressed with fingers for folding or spreading of the comb.

A conventional comb for hair combing includes generally a handle for holding by hand, and a brush portion having lines of brush pins, these pins being located in a implanting area of limited length and width. The handle and the plastic material in the implanting area of a conventional comb are normally molded integrally, and then the pins are implanted.

The conventional comb is rather long due to the integral ejection molding of its handle and the implanting area, and is inconvenient for carrying. Therefore, foldable combs were designed. They have the best advantage of having the length of the combs reduced effectively. However it is not completely automatic for folding or spreading the combs , such action must be helped by fingers to effect it, and thereby a lot of defects such as contamination of grease stain from the hair to the fingers or hurt of fingers by the brush pins can be created.

We now cite a drawing to make clear of the structure of the conventional foldable combs. Referring to FIG. 1, a standard foldable comb is shown therein, it includes generally a handle 10, the handle 10 is movably hinged at a connection 12 with a hollowed framing member 11. An elastic member 13 is provided within the framing member 11 as an implanting area for implanting of the brush pins 14.

As shown in FIG. 1 , the comb is completely spreaded and ready for use. When it is to be folded, the raised arc shape elastic member 13 should be pressed down in the direction of the arrow A, such that the pins 14 all shrink into an internal space provided in the hollowed framing member 11; then the handle 10 is bended onto the surface of the hollowed frame member 11, the total length of the comb can thereby be reduced almost a half, the comb is thereby suitable for carrying outdoors.

However, when in folding, the fingers must press the portions of the lower ends of the two outside lines of pins 14 or the limited peripheral portions of the elastic member 13 without the brush pins 14, this is really inconvenient in operation and using, and makes bother in folding of the comb. Further, the fingers pressing the pin area when in folding are subjected to contamination of the grease stain and this is not hygienic.

Not only this, when in stretching, the comb must be pushed in position as shown in FIG. 1 with hands. All the action of folding and of spreading need inevidently a manual operation, inconvenience is always existed.

SUMMARY OF THE INVENTION

The primary object of the present invention is therefore to provide an improved structure of a foldable comb, wherein an eccentric wheel having an annular grooved rail is provided at the connection between the handle and the hollowed frame of the foldable comb, a push rod being pivotally connected has its force acting axle movably connected to the grooved rail, the push rod can be extended into the cavity within the frame to push an elastic member in the implanting area, the brush pins can be stretched automatically in position when the handle is pulled out to its extended position, and can be retracted automatically when the comb is folded, there is no need of pressing or pushing of the fingers on the brush pins.

The novelty as well as other features of the present invention will be apparent when read the following description of the embodiment thereof in referring to the accompanying drawings.

Figure 4:
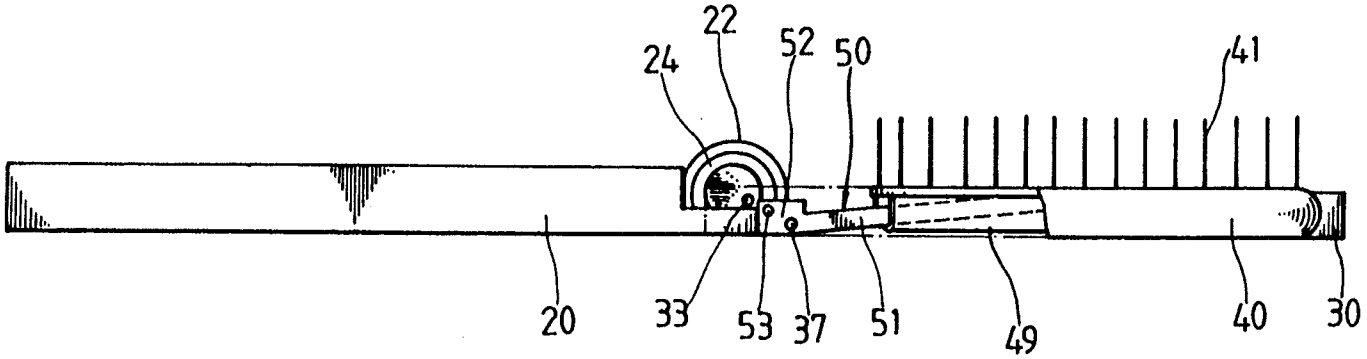
FIG. 4 is a side view of FIG. 2.

5 is a side view similar to FIG. 4 after the comb is folded.

DETAILED DESCRIPTION OF THE PREFERRED EMBODIMENT

Figure 2:
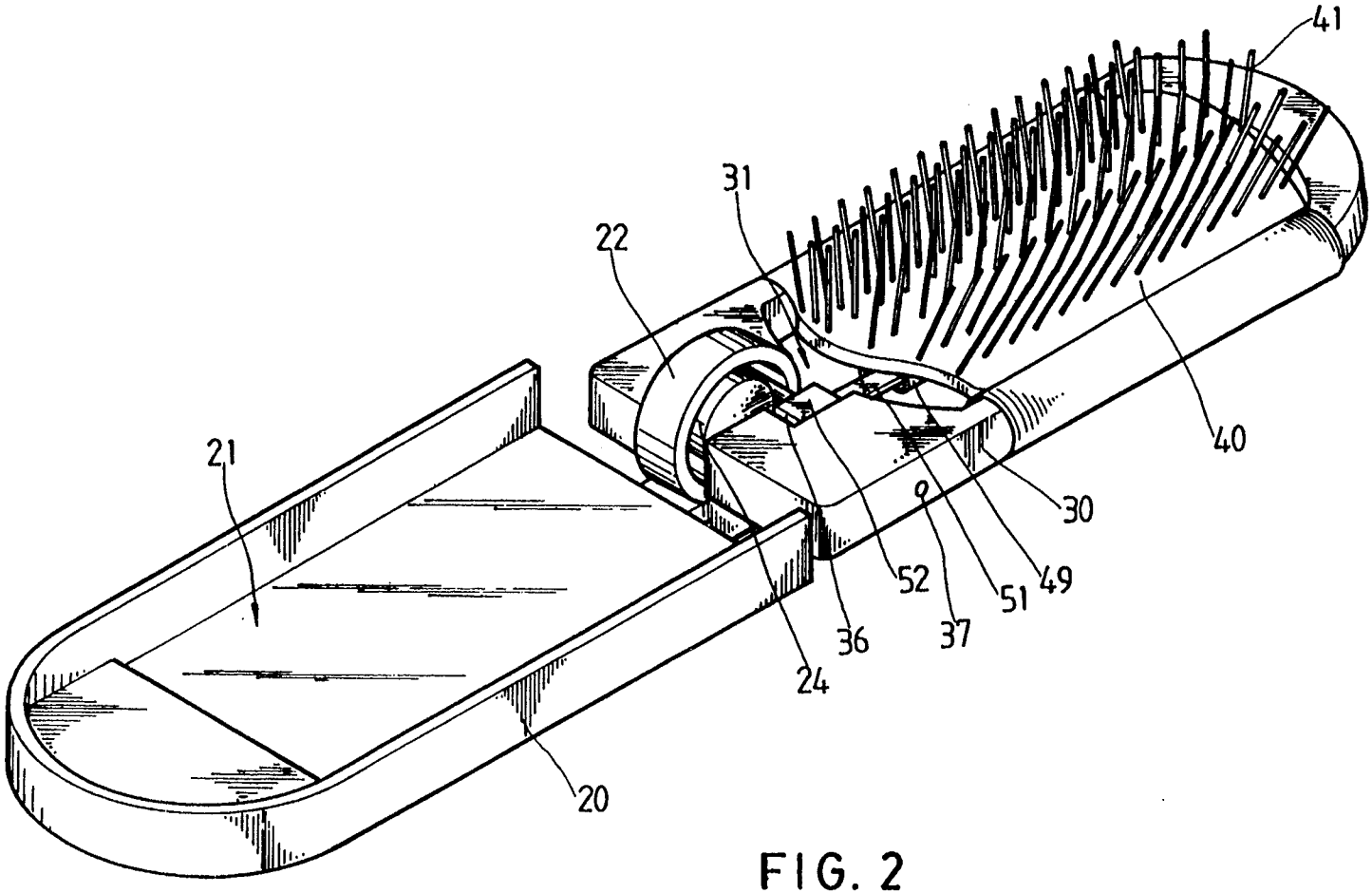
FIG. 2 is a perspective view of the present invention when in its spreaded position.

Referring to FIG. 2, the present invention has also a handle 20 and a hollowed frame 30 pivotally connected therewith on the front end thereof. The hollowed frame 30 can be completely fitted in a receiving space 2l. Also an elastic member 40 capable of implanting the brush pins is provided in a cavity 31 of the hollowed frame 30.

Figure 3:
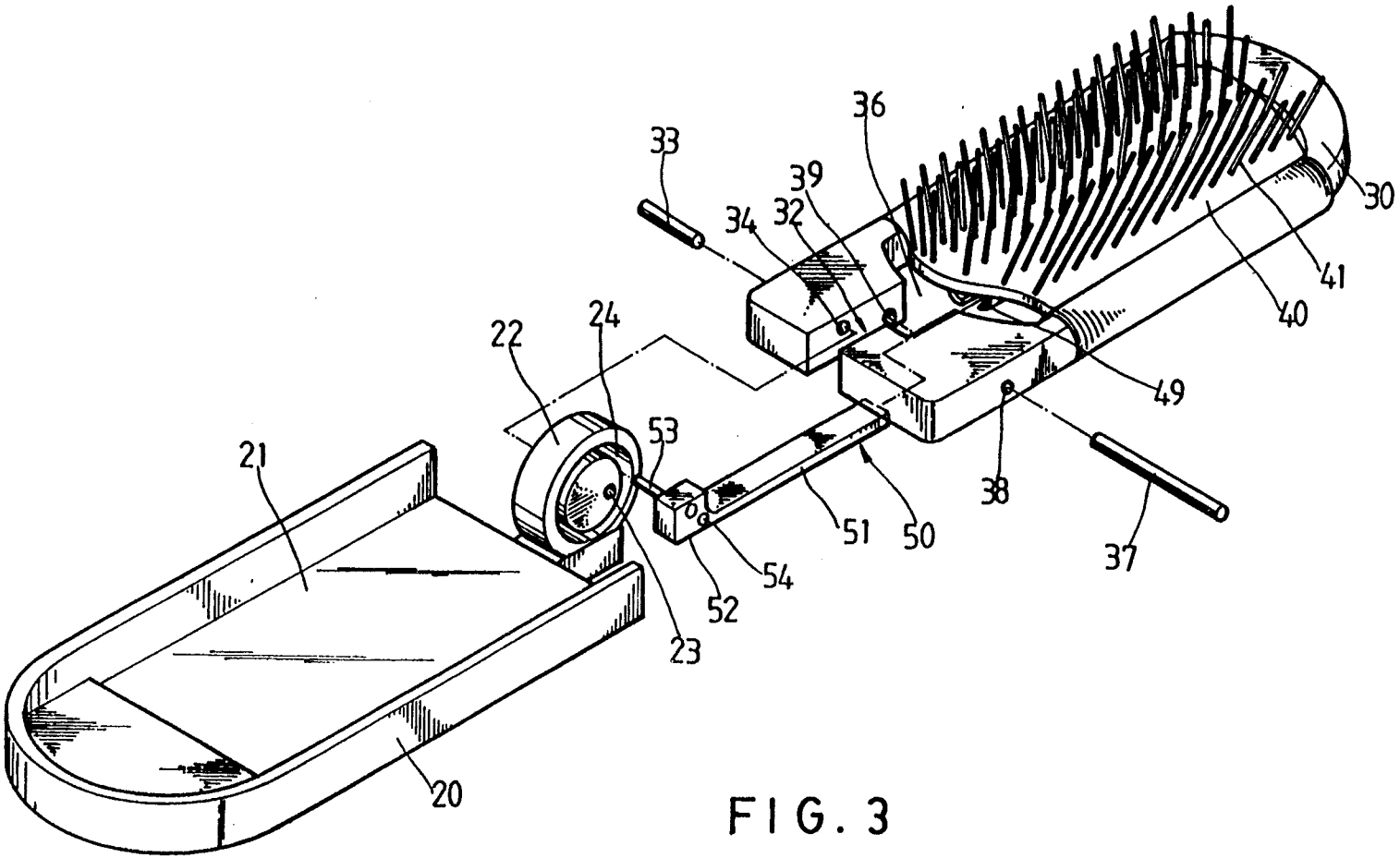
FIG. 3 is an anatonic view of the elements of FIG. 2.

Now please refer to FIG. 3 , at the rear pivotal connection of the handle 20 there is provided with an eccentric wheel 22 which has an eccentric connecting pivot hole 23 and a peripheral annular grooved rail 24.

The hollowed frame 30 has a notch 32 at the pivotal connection thereof, the eccentric wheel 22 can be disposed in it, an axle pin 33 can be extended through a prefabricated hole 34 into and connected with the eccentric wheel 22.

A push rod 50 is provided having a block 52 on the front end thereof and an elongated shank 51, a force-acting side axle 53 is provided on the block 52 and is movably inserted into the grooved rail 24 of the eccentric wheel 22. A pivot hole 54 is provided adjacent to the side axle 53. The block 52 can be put into a deviated space 36 provided in the notch 32 of the hollowed frame 30, a pin 37 is extended through the prefabricated through hole 38, 39 to form the pivotal connection. The elongated shank 51 of the push rod 50 is inserted into a prefabricated rod sheath 49 beneath the elastic member 40.

Figure 1:
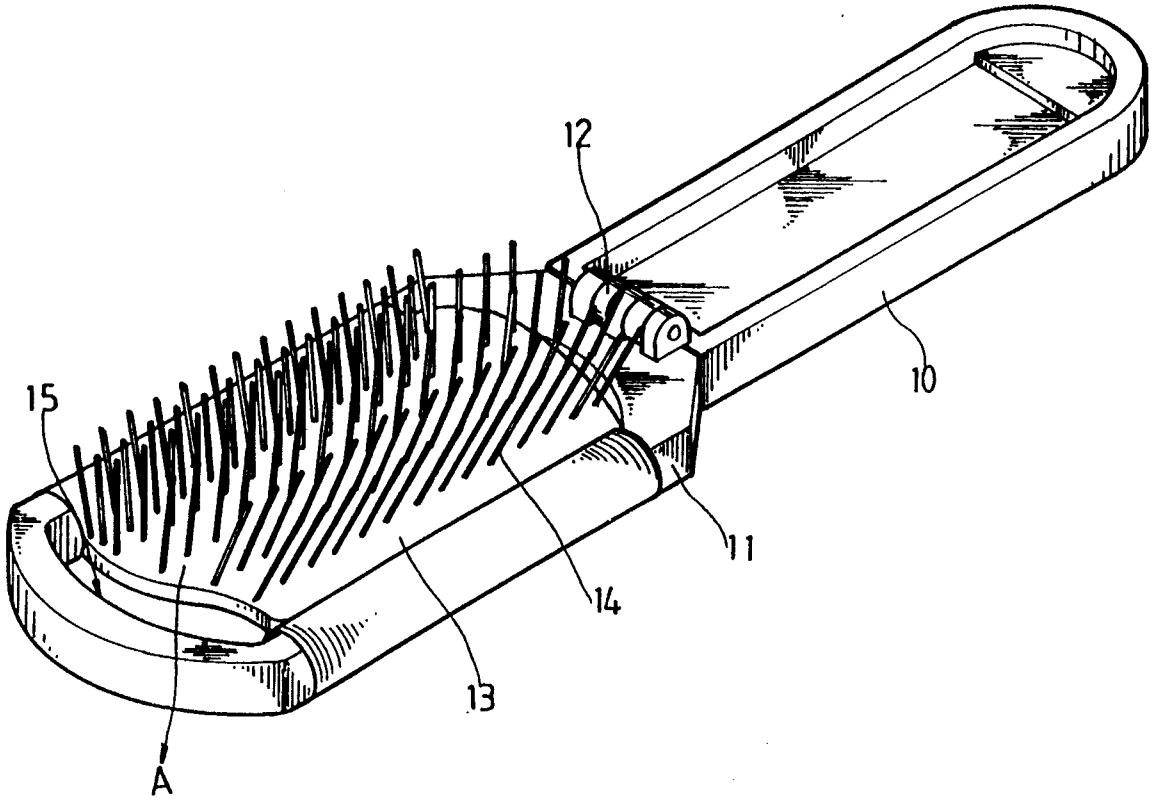
FIG. 1 is the apparent of a conventional foldable comb.

Referring to FIGS. 1, 4 , when the handle 20 and the hollowed frame 30 of the present invention is spreaded to a horizontal position, rotation of the eccentric wheel 22 will render a force to exert on the force-acting side axle 53 and to move it to the left , and therefore push the rod 50 to render the shank 51 to be in an up-raising position , thereby to push upwardly the elastic member 40 and render it to form an arc, and the brush pins 41 thereby stretch to an appropriate position ready for hair combing.

Figure 5:
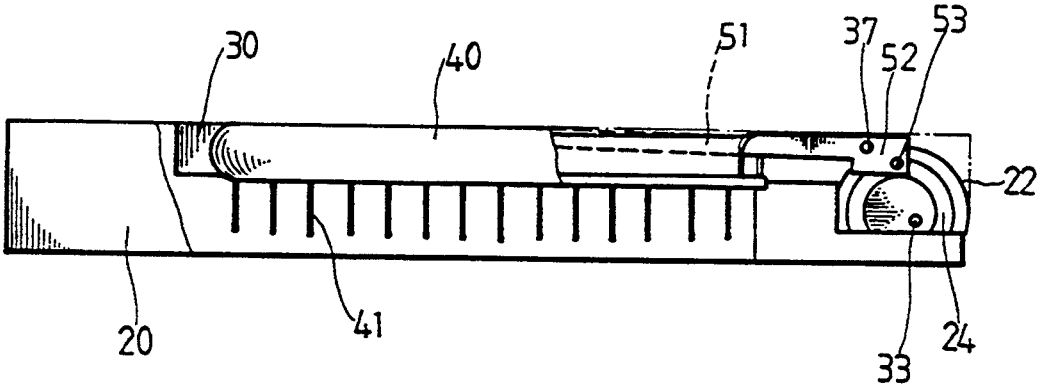

When being folded, the handle 20 and the hollowed frame 30 will be closed to render the force-acting side axle 53 to move to the right when the eccentric wheel 22 rotates counterclockwise about the eccentric pivot hole 23, therefore the shank 51 can be moved slightly down, and render the elastic member 40 to contract (such as shown in FIG. 5, wherein the shank 51 has been moved down, and has been folded onto the handle 20), all the brush pins are thereby collected in a storage position.

When the comb of the present invention is spreaded, all the pins will be in a stretched position; Similarly, when the comb is folded, the pins can also moved by the push rod to contract automatically. During the stretching and the folding processes, there is no need of pressing or pushing of the fingers on the brush pins in the implanting area, such operation thus is convenient. Thereby the defects of the conventional combs such as contamination of grease stain from the hair to the fingers or injury to the fingers by the brush pins can be effectively avoided.

Having thus stated the present invention in detail, it can be understood that the present invention can have other embodiments as well as varieties without departing from the spirit of it and the scope stated in the claims.

I claim:

1. An improved structure of a foldable comb having a handle, and a hollowed frame pivotally connected therewith, wherein:

an eccentric wheel is provided at the pivotal connection and being disposed in a notch in said hollowed frame; a push rod having a block thereon, said block being placed into said notch and having an elongated shank integral therewith, the elongated shank being inserted into a rod sheath disposed beneath an elastic member, the elastic member being disposed in a cavity of said hollowed frame to move therewith;

said block of said push rod being connected to said eccentric wheel for moving therewith;

whereby when said handle is spread from said hollowed frame, the elongated shank of the push rod stretches the elastic member upward thereby causing a plurality of brush pins disposed on an upper surface of said elastic member to be urged into the proper position for brushing hair, and when said handle is folded into said hollowed frame, the elastic member is relaxed, thus causing the brush pins to contract into a storage position within the hollowed frame.

2. An improved structure of a foldable comb as stated in claim 1, wherein a peripheral annular grooved rail is provided in said eccentric wheel, said block of said push rod being provided with a force-acting side axle for inserting into said grooved rail to move therewith.

* * * * *